US005560558A

United States Patent [19]

Wray

[11] Patent Number: 5,560,558

[45] Date of Patent: Oct. 1, 1996

[54] SPANDEX SUPPLY PACKAGE

[75] Inventor: Rhodes E. Wray, Staunton, Va.

[73] Assignee: E. I. Du Pont de Nemours and Company, Wilmington, Del.

[21] Appl. No.: 421,011

[22] Filed: Apr. 12, 1995

[51] Int. Cl.[6] ..... B65H 18/28; B05D 3/12

[52] U.S. Cl. ..... 242/165; 8/115.6; 242/18 EW; 242/172; 427/177

[58] Field of Search ..... 242/165, 18 EW, 242/164, 18 R, 172, 173; 8/115.6; 252/8.6; 427/387, 177, 178, 179

[56] References Cited

U.S. PATENT DOCUMENTS

| | | | |
|---|---|---|---|
| 1,672,844 | 6/1928 | Boyd | 242/165 |
| 1,718,629 | 6/1929 | Boyd | 242/18 EW |
| 3,044,614 | 7/1962 | Hanscom | 242/173 |
| 3,284,026 | 11/1966 | Zuidema | 242/165 |
| 3,296,063 | 1/1967 | Chandler . | |
| 3,409,238 | 11/1968 | Campbell et al. . | |
| 3,471,322 | 10/1969 | Medney | 427/177 |
| 3,511,677 | 5/1970 | Strohmaier et al. | 427/177 X |
| 3,701,490 | 10/1972 | Wray . | |
| 3,788,826 | 1/1974 | Klink et al. | 242/18 R X |
| 4,398,676 | 8/1983 | Koppen et al. . | |
| 4,995,884 | 2/1991 | Ross et al. | 8/115.6 |
| 5,232,742 | 8/1993 | Chakravarti | 8/115.6 X |

*Primary Examiner*—Michael R. Mansen

[57] ABSTRACT

A spandex supply package has a cylindrical core on which is wound spandex having a surface lubricating finish. The last few hundred meters of the wound-up spandex, which constitute about 0.1 to 0.5% of the total length of spandex wound up in the package, has less than half the concentration of finish as does the remainder of the wound-up spandex in the package.

5 Claims, 1 Drawing Sheet

SPANDEX SUPPLY PACKAGE

BACKGROUND OF THE INVENTION

1. Field of the Invention

This invention relates to a spandex supply package having a cylindrical core on which is wound spandex that has a lubricating finish on its surface. More particularly, the invention concerns such a supply package wherein the amount of lubricating finish on the outer windings of spandex is considerably less than the amount of lubricating on the rest of the wound-up spandex. As a result of the decreased amount of lubricating finish on the surface of the outer windings, the stability of the package, especially with regard to sloughing-off of yarn from the package shoulders during shipping and handling, is greatly reduced.

2. Description of the Prior Art

Spandex is a manufactured fiber in which the fiber-forming substance is a long chain synthetic polymer comprised of at least 85% by weight of a segmented polyurethane. Most spandex is produced by dry spinning techniques and inherently is quite tacky. To avoid adherence of the spandex to itself when wound up in a supply package, as well as to avoid other problems in subsequent use of the spandex, lubricating finishes, such as silicone oils, are applied to the surface of the spandex prior to windup. Typically, the weight of the finish on the spandex amounts to in the range of 2 to 10% of the weight of the spandex.

To form a spandex supply package, such as a bobbin, cake, cheese, or the like, spandex is wound up on a cylindrical core. Equipment for this purpose is well known. For example, U.S. Pat. Nos. 4,398,676 (Koppen et al), 3,701,490 (Wray) and 3,409,238 (Campbell et al), among others, disclose apparatus for high speed winding of spandex thread-lines onto tubular cores to form spandex supply packages. However, during shipping and handling of such supply packages difficulties are sometimes encountered. For example, the spandex sometimes sloughs off the edges of the wound-up packages (i.e., the spandex near the flat circular faces of the wound up package falls off the edges of the package). Also, if the package is held with the cylindrical core in a vertical position during shipment, the spandex sometimes can slough off from the package and fall to the bottom of the shipping container. A similar phenomenon sometimes occurs when the spandex package is removed from the shipping container and the spandex sloughs off onto the floor. The sloughing off of spandex from a supply package creates time-consuming difficulties and waste in subsequent textile operations, such as beaming, warping, knitting, weaving, mechanical covering, air-jet entangling and the like.

Lubricating finishes for spandex and equipment for applying the finish to the spandex are well known. For example, U.S. Pat. No. 3,296,063 (Chandler) discloses certain polysiloxanes as suitable finishes for spandex. Japanese Patent Application Publication 63-66073 (Maruyama et al) describes a polyurethane elastic yarn supply package in the form of a cheese, in which the amount of finish applied to the yarn depends on the apparent elongation of the yarn within the cheese. The amount of finish generally is less on the yarns near the center of the yarn package than on the yarns near the outside of the package. Among the numerous conventional techniques used to apply the lubricating finishes to the surfaces of moving spandex thread-lines just before their windup into a supply package, are dipping, padding, spraying and the like. Known devices for applying such finishes to spandex include oiling rollers, atomizers, and the like.

An object of the present invention is to eliminate, or at least greatly ameliorate, the problem of spandex sloughing off the edges of supply packages.

SUMMARY OF THE INVENTION

The present inventor found an unexpected relationship between the problem of spandex sloughing off supply packages and the amount of lubrication on the last few hundred meters of spandex wound up on the supply package. With the discovery of this relationship, the present inventor was able to satisfy the object of the invention. The above-noted prior art did not address the sloughing-off problem or recognize any relationship between the sloughing-off and the amount of lubricating finish on the spandex.

The present invention provides a spandex supply package of the type in which the spandex is wound up on a cylindrical core and the spandex has a lubricating finish on its surface. For decreased sloughing off of the spandex from the package, at least the last 100 meters, preferably the last 500 meters, of the wound up spandex has a decreased amount of finish, which is less than one-half the average amount of finish on the rest of the spandex in the supply package. Preferably, the weight of the finish on the length of spandex having the decreased amount of finish is in the range of 0.2 to 2% of the total weight of the spandex. Preferably, the length of spandex having the decreased amount of finish constitutes in the range of 0.1 to 0.5% of the total length of spandex wound up in the package.

The invention also includes a simple method for producing the improved spandex yarn supply package.

BRIEF DESCRIPTION OF THE DRAWINGS

The invention will be better understood by reference to the drawings wherein.

DETAILED DESCRIPTION OF PREFERRED EMBODIMENTS

The following descriptions of preferred embodiments of the invention are included for purposes of illustration and are not intended to limit the scope of the invention, which scope is defined by the appended claims.

Figure 1:
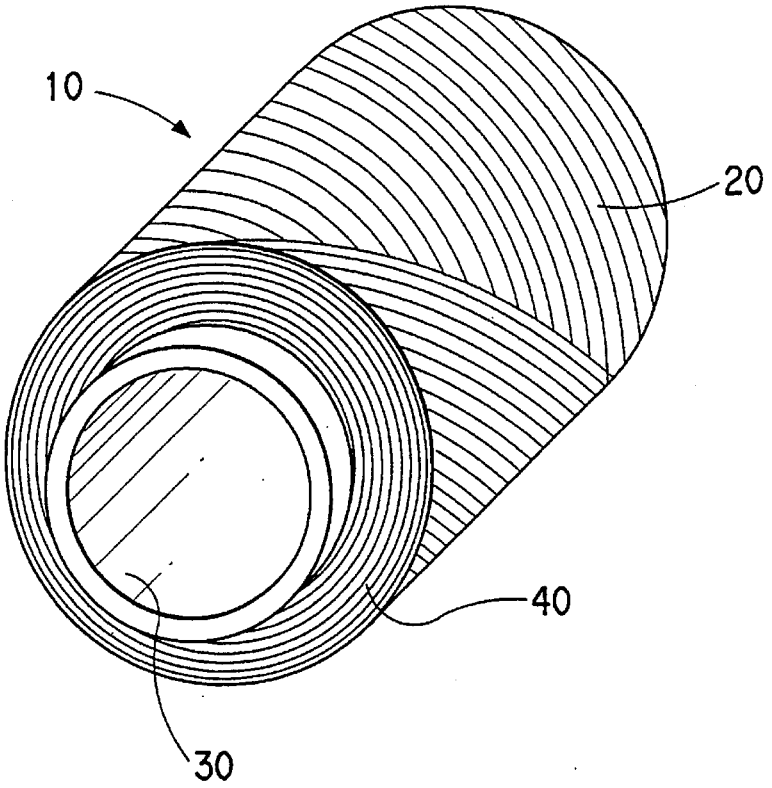
FIG. 1 is an isometric view of a typical supply package of the invention and FIG. 2 is a side view of the supply package.
Figure 2:
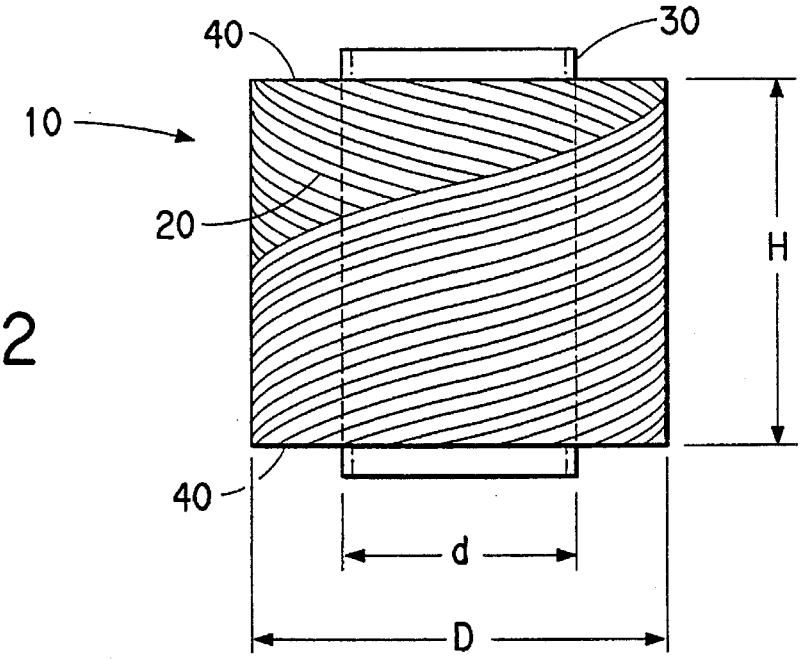

Spandex yarn supply packages come in a variety of sizes. As depicted in FIG. 1 and FIG. 2 of the drawings, a typical commercial spandex supply package 10 has spandex 20 helically wound up on a cylindrical tube 30. The length and the outer diameter of tube 30 are each 4 inches (10.2 cm). Spandex 20 forms a wound up package, centrally located along the length of tube 30. The wound-up spandex package has flat faces 40, an outer diameter D of 6 inches (15.2 cm), a height H of 3.5 inches (8.9 cm) and an inner diameter d of 4 inches (10.2 cm) corresponding to the outer diameter of tube 30. Such a typical package contains 1.1 pounds (0.5 Kg) of spandex. The total length of spandex in such a package depends, of course, on the denier (dtex) of the spandex. For example, a 0.5-Kg package would contain 450,000 meters of 10-denier (1.1-dtex) spandex or 112,500 meters of 40-den (44-dtex) spandex.

Usually, all the spandex wound up in a supply package has had a lubricating finish, typically a silicone oil, applied to the spandex surface. The lubricating finish nominally weighs between about 2 to 10% of the total weight of the spandex. Commonly, the finish averages about 3 to 6% by total weight of the spandex. In conventional dry-spinning operations for producing spandex, finish is applied to the spandex thread-line, just downstream of the spinning cell, as the spandex advances at speeds usually in the range of 300 to 2000 meters per minute to a windup.

In accordance with the invention, the problem of spandex sloughing off from wound up supply packages is greatly diminished by decreasing of the amount of lubricating finish applied to the last several hundred meters of spandex being wound up to form the supply package. The amount of finish on the spandex in the outer layers of windings of the spandex on the package, according to the invention, is decreased to less than half the amount that is in the remaining major portion of spandex in the package. The windings having decreased lubricating finish and constituting the outer layers of the spandex preferably have between 0.1 and 0.5% finish (based on the weight of the spandex to which it is applied). At least the last 100 meters of spandex wound up on the package has the decreased amount of lubricating finish. Preferably, the decreased amount of lubricating finish is limited to no more than the final 500 meters of spandex wound on the package. For packages weighing about 0.5 kilogram, the spandex having the decreased amount of lubricating finish would be only 0.1 to 0.5% of the total spandex in the package.

The present inventor believes that the decreased amount of lubricating finish on the final windings of the spandex on the package increases the friction between adjacent filaments sufficiently so that the spandex no longer sloughs off the edges of the package and the edges of the package are stabilized. About 500 to 2000 turns of spandex with decreased finish are believed to be sufficient to stabilize the outside of the spandex package. The length of spandex with decreased finish on the package surface depends on the circumference of the package and the size of the fiber. Larger packages and heavier deniers require the longer lengths of spandex with a decreased amount of surface lubricating finish to obtain a satisfactory package. Conversely, smaller diameter packages of lighter denier spandex require the shorter lengths of spandex with a decreased amount of surface lubricating finish at the outside of the supply package. The present invention is useful for supply packages of commercial spandex deniers, for example, from about 10 denier (11 dtex) or less to 2240 denier (2500 dtex) or more.

The method for decreasing the amount of lubricating finish on the spandex in the final windings of a spandex supply package in accordance with the invention is quite simple. The specific method depends somewhat on the type of finish applicator that is being used. For example, if an atomizing spray is being used, the flow of lubricating finish that is applied to the spandex can be decreased in a predetermined manner by controlling the opening or closing of the valve that feeds the finish to the atomizer. Similarly, when an oiling roller is employed, the rate of roller rotation can be decreased to decrease the amount of finish applied to the spandex. However, an even simpler, effective way of decreasing the amount of finish being applied, is to just stop the rotation of the roller during the last minute or two, before the final length of spandex is wound up on the package and the package is prepared for doffing.

As a result of applying lubricating finish to spandex in accordance with the invention, the spandex from the resultant supply package is much easier to handle in preparation for beaming operations. Furthermore, spandex from supply packages of the invention is less prone to tangling during back-winding. Accordingly, subsequent processing operations with the spandex are improved.

EXAMPLES

The results reported in the following examples are believed to be representative of the studies carried out with regard to the present invention, but do not include all the materials and equipment studied. The examples illustrate the invention with the fabrication of a spandex supply packages having a decreased amount of finish in the final outermost windings of the package. The advantageous effects of the invention are demonstrated by comparing the supply packages of the invention with conventional supply packages wherein the amount of lubricating finish on the spandex is constant throughout the supply package. Tests of spandex supply packages according to the invention are designated with Arabic numerals. Comparison Tests, with conventional spandex supply packages, are designated with upper case letters.

In each of the following examples, commercially dry-spun, 40-den (44-dtex) spandex was formed into multiple, helically wound, spandex supply packages on equipment, including traverse guides, drive rolls, windups, etc., of the kind illustrated in Koppen et al, U.S. Pat. No. 4,398,676. The drive rolls were rotated at 2900 revolutions per minute; the guides traversed the filaments back and forth parallel to the windup roll three times per drive roll revolution and placed about 12 inches (30.5 cm) of spandex length onto the tube of the supply package with every revolution of the drive roll. The spandex used in these tests was prepared from poly-(tetramethyleneether) glycol of 1800 number average molecular weight which was capped with methylene-bis-(4-phenylisocyanate) at a capping ratio of 1.7 and then chain-extended with a 90/10 molar ratio mixture of ethylene diamine and 2-methyl-1,5-pentanediamine. Diethylamine was used as a chain terminator. The following additives were dispersed within the spandex:

(a) 1.5% Cyanox® 1790, 1,3,5-tris(4-t-butyl-3-hydroxy-2, 6-dimethylbenzyl)-1,3,5-triazine-2,4,6 (1H,3H,5H) trione, antioxidant sold by Cytec Industries of West Patterson, N.J.;

(b) 2.0% of Methacrol®, made by DuPont, a copolymer of diisopropylaminoethyl methacrylate and n-decyl methacrylate;

(c) 0.6% silicone oil;

(d) 3.0% zinc oxide; and (e) 1.5% barium sulfate. (Note: Barium sulfate was omitted from the spandex of Example 2).

A lubricating finish composition, which was a mixture of 96 weight % silicone oil and 4% magnesium stearate, was applied to the spandex to provide 4.5 weight % lubricating finish to the spandex throughout the supply package, except on the outer windings of the package. The lubricating finish was applied to the spandex by a motor-driven, 1.5-inch (3.8-cm) diameter, ceramic coated oiling roller, having a 600-rms surface roughness and being rotatable at up to 25 rotations per minute. The spandex-to-roll contact distance was between ⅜ and ⅝ inch (between 1 and 1.6 cm). Tension in the spandex, which was maintained sufficient to keep the spandex in contact with the oiling roller, resulted in a 7% stretch in the spandex across the roller. The spandex was wound up with a total stretch of 22.5% at a speed of 65 yards/min (882 meters/min), to form a 1.1 pound (0.5 Kg) spandex supply package.

To determine the amount of silicone finish that was applied to the spandex, a 100-yard (91.4-meter) long sample of the spandex was treated with Perclene® tetrachloroethylene solvent to form an extract. The pure solvent has an infrared absorbance of less than 0.50 as compared to an air reference in a 0.5 mm cell from a baseline at 1320 cm–1 to the Si-CH3 peak at about 1260 $cm^{-1}$. A Finish on Yarn Analyzer, Model 8980, equipped with IR Detector Model DT 980 (sold by Duratech, Inc., Waynesboro, Va.) was used. The finish content was calculated from the IR absorbence of the Si-CH3 peak and related to % concentration by calibration curves. Average measured finish levels on the 100-yard (91.4-m) lengths of spandex are expressed as a percent of spandex weight. The reference to the distance from the end of the package refers to the length removed from the wound-up supply package as it is unwound (i.e., from the last wound outermost windings to the first wound innermost windings).

In each example, the amount of finish was decreased on the spandex on the outside of the supply package by turning the finish roll motor off and immediately stopping the rotation of the roll about a minute or so before the supply package was complete. Accordingly, at the wind-up speeds of the examples, about 965 yards (882 meters) to 2000 yards (1828 meters) of spandex at the outside of the package had decreased amounts of lubricating finish. When the finish roll rotation was stopped only a thin residual film of finish remained on the surface and this finish was removed by the spandex that was running across the roll surface. The spandex in contact with the stopped roller then became the spandex wound up on the outside of the supply package.

In Example 1 and 2, the advantages of the spandex supply packages of the invention having decreased lubricating finish on the outside windings of the package over similar supply packages in which the amount of lubricating finish is maintained constant throughout, are demonstrated in using the packages for beaming string-up (also called "pulling through") operations. A Liba warper, made by Liba Maschinenfabrik, of Naila/Bayern, Germany was used for the evaluations of the spandex supply packages.

EXAMPLE 1

This example describes three tests of spandex supply packages of the invention, Tests 1, 2 and 3, and three comparison tests with conventional spandex supply packages, Tests A, B and C. The supply packages were prepared as described above. Specimens of the spandex back-wound from the supply packages were analyzed for the amounts of lubricating finish on the spandex. The following table, which summarizes the results, reports the amounts of finish in weight % (based on the weight of the spandex) and the distances in yards from the start of the first strand unwound from the package. Except for the lengths of spandex listed in Table 1, below, the amount of finish applied to the remainder of the spandex in the supply packages of the invention and to all the spandex of the comparison supply packages averaged 4.5 weight %.

TABLE 1

(Example 1)
Weight % Finish on Spandex Packages from Tests 1, 2 and 3

| Yards (meters) from end | Wt. % finish |
|---|---|
| 2100 (1920) | 4.5 |
| 700 (640) | 4.2 |
| 400 (366) | 4.0 |
| 150 (137) | 1.1 |

Results of a beaming string-up evaluation test with a Liba warper are summarized in the following table. The creel and warper head model of each test is listed in the table below. Table 2 below records the total number of man-hours required to accomplish the string-up with each type of spandex supply package and the number of sloughs encountered during the creeling and pulling through. Each test was performed with 1344 supply packages.

TABLE 2

Beaming Tests (Example 1)

| | Liba Model | | Man-hours | Number of |
|---|---|---|---|---|
| Test | Creel | Warper* | String-up | Sloughs |
| 1 | 6F | 24E | 1.7 | 21 |
| A | 6F | 24E | >4 | >80 |
| 2 | 6E | 23E | 1.8 | 18 |
| B | 6E | 23E | 6.0 | 82 |
| 3 | 6E | 24E | 2.9 | 31 |
| C | 6E | 24E | 4.5 | 84 |

*Refers to warper head model designation

The above-summarized results show that use of the spandex supply packages of the invention significantly decreased the time required for string-up, by 35 to 70%. Furthermore, note that the number of sloughs from the packages that had uniform a uniform amount of lubricating finish throughout the entire package had 2.6 to 4.6 times as many undesirable sloughs as did the spandex supply packages of the invention.

In a shipping and unpacking evaluation test, spandex supply packages of the invention made for Test 3 were compared with conventional supply packages made in accordance with Sample C. Whereas no sloughing off was found in 192 spandex supply packages according to the invention, 27 slough-offs were found in 192 conventional comparison spandex supply packages that were shipped and unpacked in the identical manner.

EXAMPLE 2

The procedures of Example 1 were repeated to produce the spandex supply packages used in this example for another beaming evaluation test of the spandex supply packages. The concentrations of lubricating finish on the spandex as a function of distance from the start of the first spandex unwound from the package is listed below in Table 3. The concentration of lubricating finish on the rest of the spandex in the test supply packages as well as that in the supply packages of Comparison Test D was 4.5 weight %.

TABLE 3

(Example 2)
Weight % Finish on Spandex Packages
from Tests 4, 5 and 6

| Yards (meters) from end | | Wt. % finish |
|---|---|---|
| 1000–600 | (914–548) | 4.3 |
| 600–400 | (548–366) | 3.2 |
| 400–300 | (366–274) | 2.6 |
| 300–200 | (274–183) | 2.4 |
| 200–100 | (183–91) | 1.7 |
| 100–0 | (91–0) | 1.2 |

Beaming string-up evaluation tests were performed with the spandex supply packages of this example in the same manner as in Example 1.

TABLE 4

Beaming Tests (Example 2)

| | Liba Model | | Man-hours | Number of |
|---|---|---|---|---|
| Item | Creel | Warper* | String-up | Re-ties[1] |
| 4 | 6F | 24E | 0.8 | 0 |
| 5 | 6F | 24E | 1.7 | 0 |
| 6 | 6E | 23E | 0.8 | n.m.[2] |
| D | 6F | 24E | 3.5 | 4 |

Notes:
*Refers to warper head model designation.
[1]Number of knots tied to re-connect spandex broken during pull-through.
[2]n.m. = not measured The tabulated results demonstrate the clear superiority of the spandex supply packages with the decreased amount of lubricating finish on the surface windings of the spandex over conventional spandex supply packages having a uniform concentration of lubricating finish on all the spandex in the package.

I claim:

1. A spandex supply package having spandex wound up on a cylindrical core and the wound-up spandex having a surface lubricating finish, characterized in that, for decreased sloughing off of the spandex from the package, at least the last 100 meters of wound-up spandex has a decreased amount of surface lubricating finish, compared to the average amount of surface lubricating finish on remainder of the spandex wound up on the core, the decreased amount being less than one-half the average amount of such finish on the surface of the wound-up spandex in the remainder of the supply package, the at least last 100 meters of spandex wound on the core constituting in the range of 0.1 to 0.5% of the total length of spandex wound up in the package.

2. A spandex supply package according to claim 1 wherein no more than the last 500 meters of spandex wound up atop the remainder of the spandex wound up on the core has the decreased amount of finish on the surface.

3. A spandex supply package according to claim 1 or 2 wherein the weight of lubricating finish on the length of spandex having the decreased amount of lubricating finish is in the range of 0.2 to 2% based on the total weight of the spandex in the length of the spandex having the decreased amount of lubricating finish.

4. A process for preparing a spandex supply package, wherein a finish applicator applies a lubricating finish at a set rate to a moving spandex thread-line and then the spandex is wound up on a cylindrical core characterized in that the application rate of the lubricating finish is decreased to less than half the set rate in the last 100 to 500 meters of spandex being wound on the core, the last 100 to 500 meters of spandex wound on the core constituting in the range of 0.1 to 0.5% of the total length of spandex wound up in the package.

5. A process according to claim 4 wherein the applicator comprises a rotating finish roll, the roll is maintained in contact with the moving spandex thread-line, and the rotation of the roll is stopped within 2000 meters of the last length of spandex to be wound up on the core, and while the roll rotation has stopped, contact is still maintained between the moving spandex thread-line and the finish roll.

* * * * *